US005853179A

United States Patent [19]

Chapman

[11] Patent Number: 5,853,179

[45] Date of Patent: Dec. 29, 1998

[54] ROLLER SKATE ATTACHMENT

[76] Inventor: Malcolm Chapman, 8 Angotts Mead, Stevenage SG1 2NJ, United Kingdom

[21] Appl. No.: 875,244

[22] PCT Filed: Jan. 23, 1996

[86] PCT No.: PCT/GN96/00130

§ 371 Date: Jul. 22, 1997

§ 102(e) Date: Jul. 22, 1997

[87] PCT Pub. No.: WO96/22818

PCT Pub. Date: Aug. 1, 1996

[30] Foreign Application Priority Data

Jan. 23, 1995 [GB] United Kingdom ..... 9501273

[51] Int. Cl.[6] ..... A63C 17/06

[52] U.S. Cl. ..... 280/11.22; 280/11.27

[58] Field of Search ..... 280/11.22, 11.23, 280/11.27, 11.28, 11.19

[56] References Cited

U.S. PATENT DOCUMENTS

| | | | |
|---|---|---|---|
| 4,666,168 | 5/1987 | Hammill et al. | 280/11.27 |
| 5,092,614 | 3/1992 | Malewicz | 280/11.27 |
| 5,277,437 | 1/1994 | Moats | 280/11.01 |

*Primary Examiner*—Richard M. Camby
*Attorney, Agent, or Firm*—Larson & Taylor

[57] ABSTRACT

An in-line skate attachment has a row of in-line wheels (11) supported in a flexible carriage (12), itself supported on a rigid carrier (7). The carrier can be attached to or form part of a skating boot (13). The flexibility of the carrier allows the wheels to move radially to suit skating conditions, e.g., a speed mode in which the wheel axes are in a plane and a turning mode in which the axes of the end wheels are lifted out of that plane.

5 Claims, 6 Drawing Sheets

ROLLER SKATE ATTACHMENT

The invention relates to in-line roller skates, otherwise known as roller blades.

Figure 1:
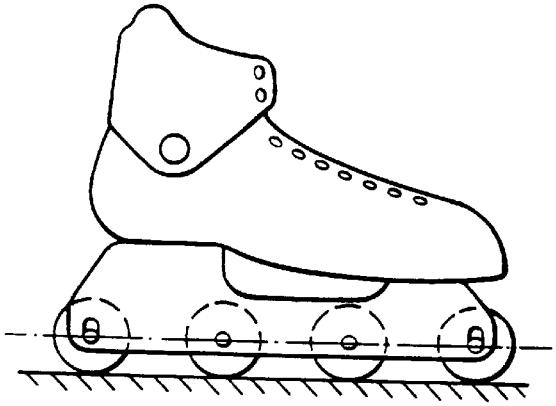
Figure 2:
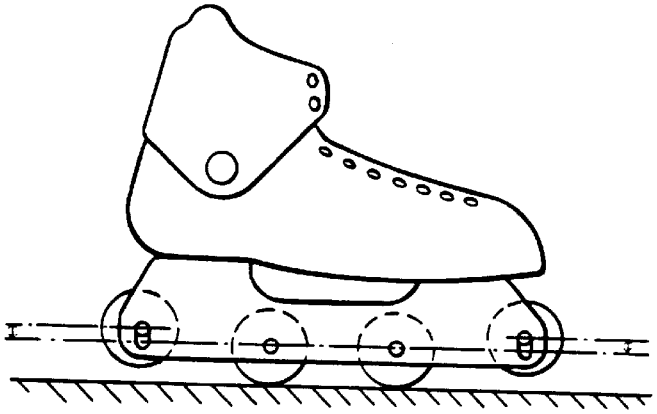
Figure 3:
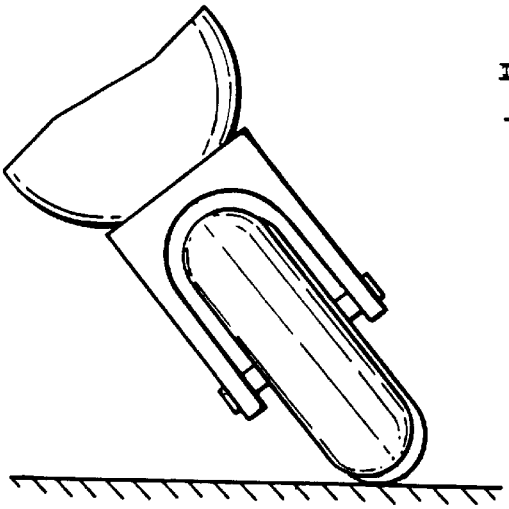
Figure 3:
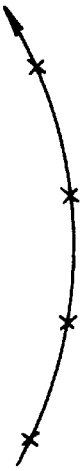

FIGS. 1–3 show examples of prior art in-line roller skates. In-line roller skates, irrespective of the number of wheels, perform more favourably for straight line travel in terms of rolling performance, or speed, when the wheels are all on the same horizontal plane, and therefore all in contact with the ground and equally sharing the load provided by the mass of the skater. FIG. 1 displays an in-line roller skate with the wheels set level.

When turning corners, in-line roller skates perform better when the foremost and rearmost wheels are raised slightly relative to the other wheels. With this arrangement, so long as the wheels are held upright by the skater, the wheels are not all in contact with the ground, as shown in FIG. 2. This arrangement is known as 'rocking' as the skate pitches on the centre wheel or wheels. Whereas the common tangent of the wheels in FIG. 1 is a straight line, that in FIG. 2 is a curve, concave upwards.

With the skate set with this 'rocking' arrangement, and should the skater lean to either side, so that the wheels deviate laterally from the vertical, all the wheels may come into contact with the ground as shown in FIG. 3*a* with the contact points creating a curve as shown in FIG. 3*b*, thereby providing a simple form of steering.

Existing in-line roller skates are frequently provided with mechanical means of changing the arrangement of the wheels from 'level' to 'rocking' leaving the skater to make the choice between rolling or cornering performance, as it is not possible to have the best of both arrangements at the same time.

U.S. Pat. No. 5,330,208 discloses an in-line roller skate adapted to navigate rough surfaces. It provides a flexible chassis mounted directly on the boot. Conventional shock absorbers can be fitted to the wheel axle bearings, or the flexing of the chassis can accommodate the shocks. In the latter case the chassis can be formed with apertures which open or close with applied forces and into which different shock absorbers can be fitted to control the hardness of the ride.

I have discovered that, in order to provide strength and desired modes of flexing between the central region of the skate and its ends, the chassis should be secured to a rigid carrier and the securing should extend over an extended central region, limited to allow flexing over substantial end regions. The invention provides in one aspect a roller skate attachment for securing to a boot comprising a single row of aligned wheels for travelling on the ground, a resilient chassis for supporting the wheels and a rigid carrier secured to the chassis at at least two fixing points, the carrier being adapted for securing to a boot, the chassis being resiliently deformable in the plane of rotation of the wheels, the distance between the axis of the front wheel and the axis of the rear wheel being at least 1.5 times the distance between the front fixing point and the rear fixing point. Optional features of the invention are set out in the subsidiary claims. The invention in another aspect provides the combination of the attachment with the boot.

Figure 4:
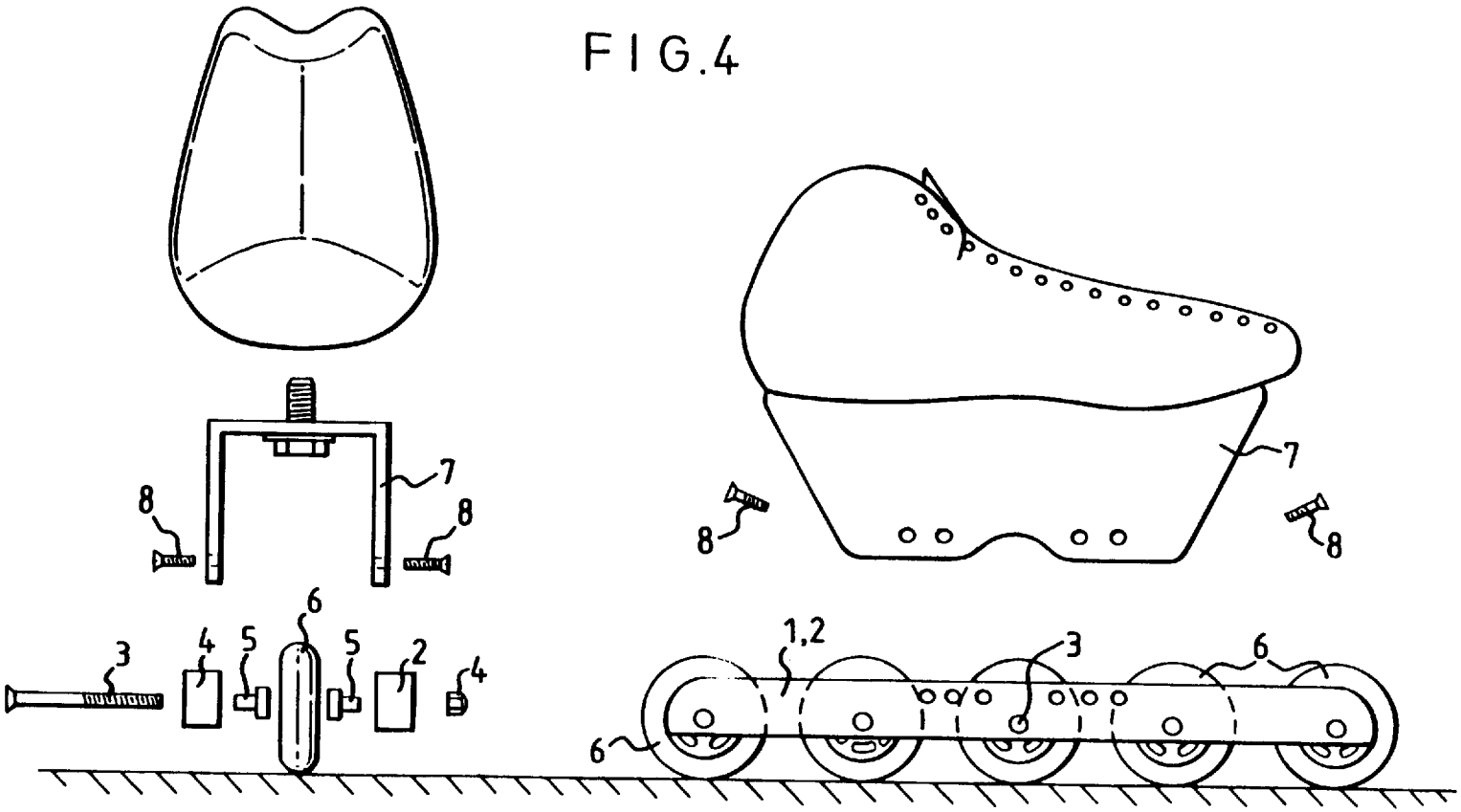
Figure 5:
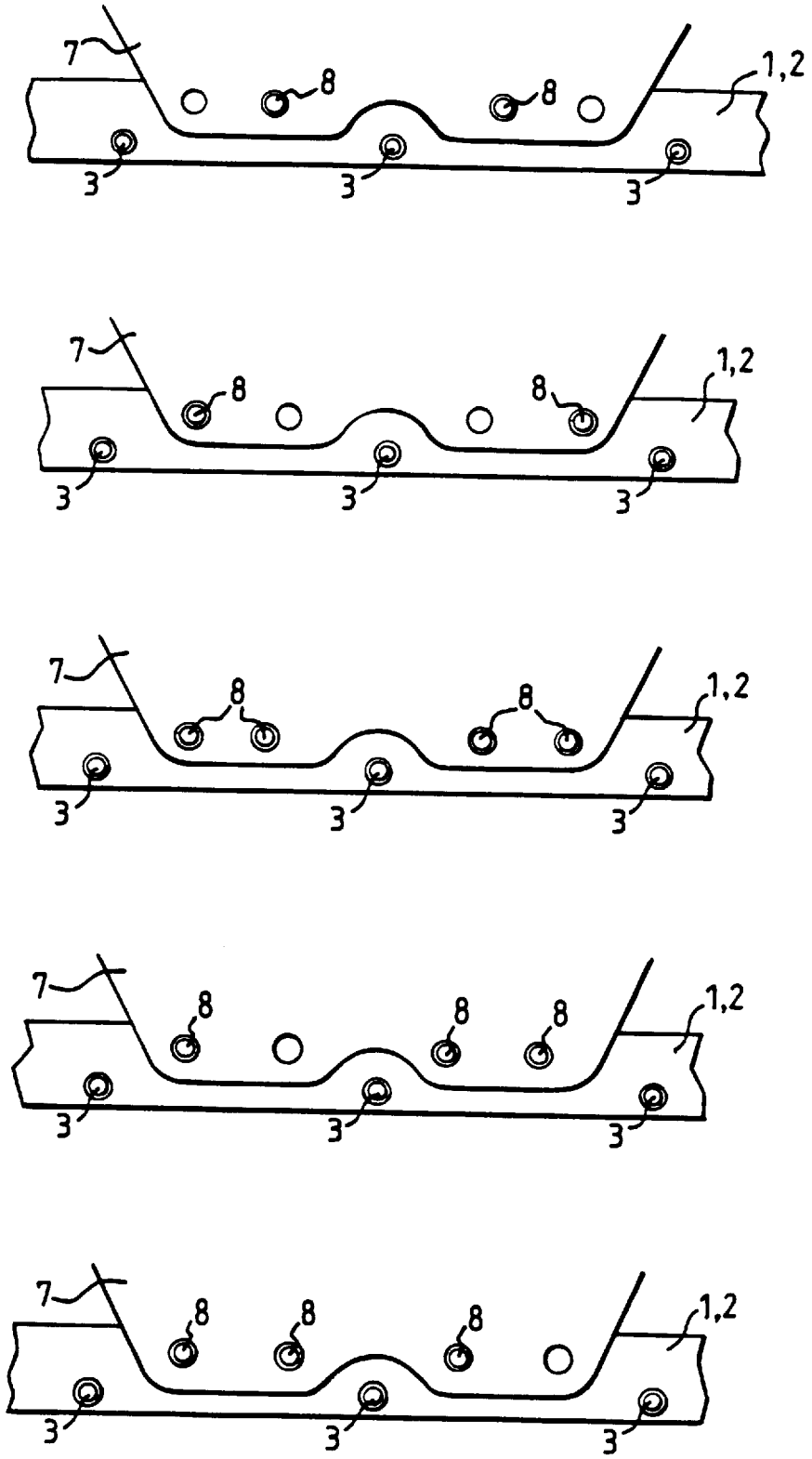
Figure 6:
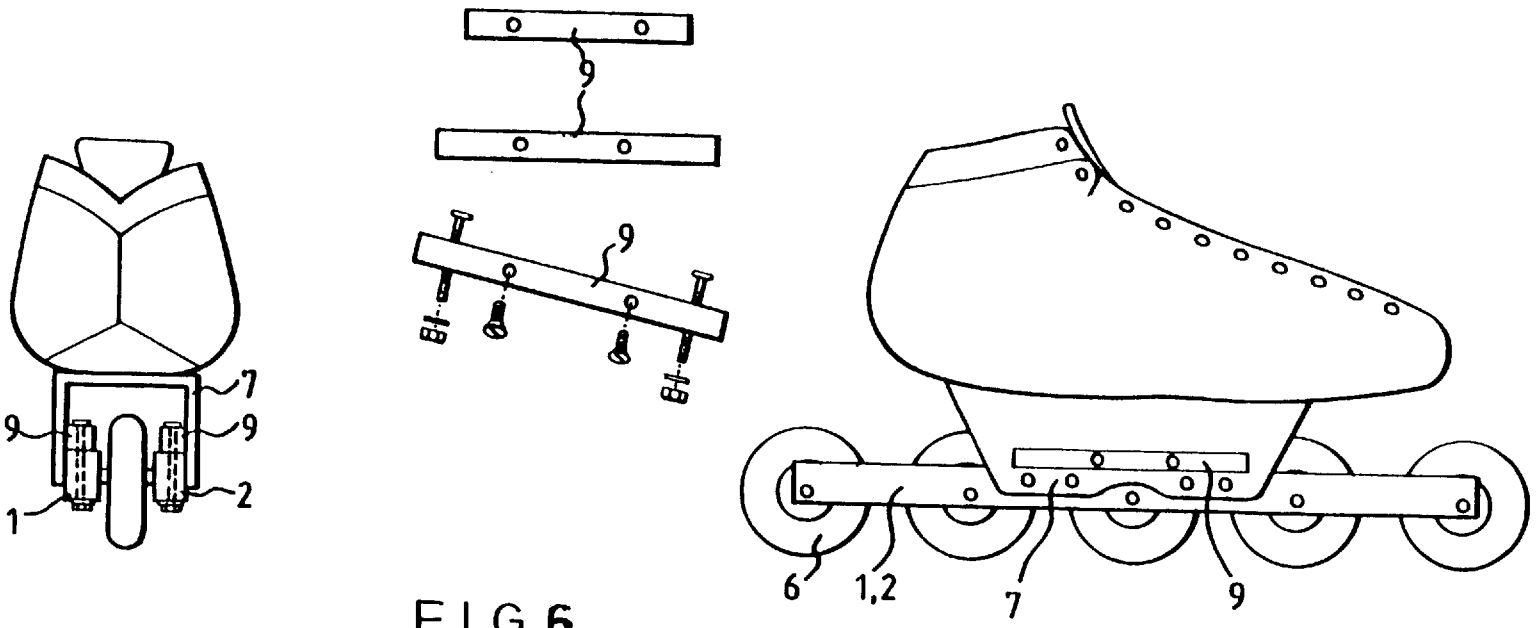
Figure 7:
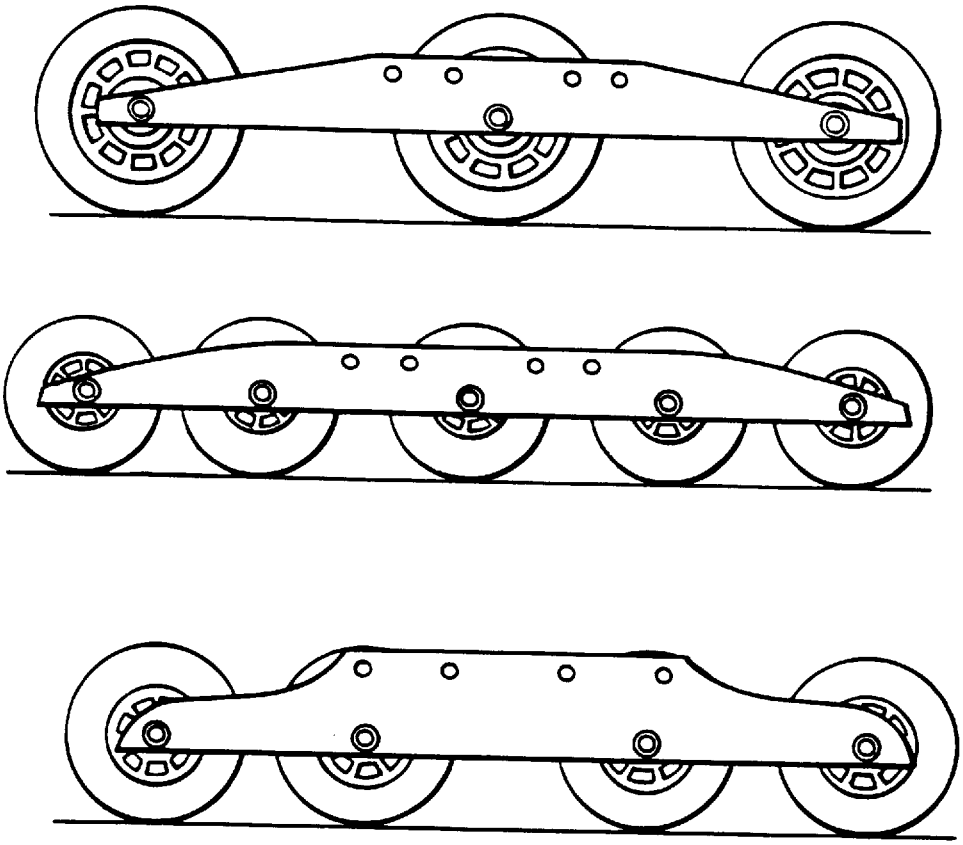
Figure 8:
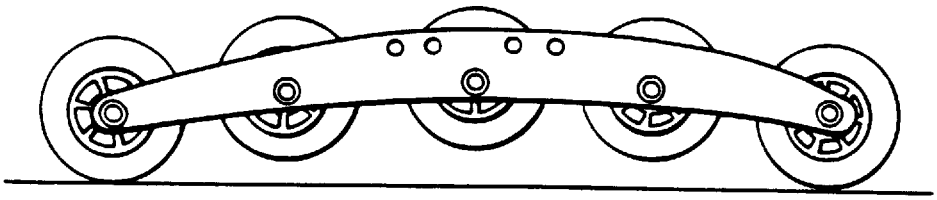
Figure 9:
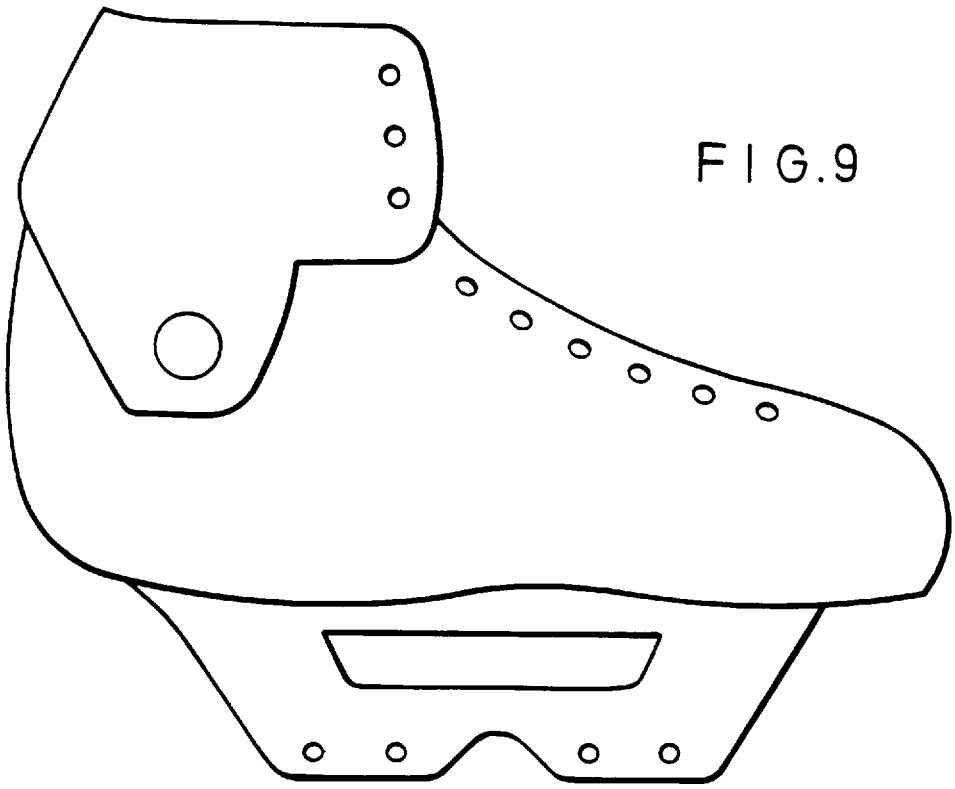

In the accompanying drawings, examples of the prior art and of the invention are illustrated:

FIG. 1 is a side elevation of an entire roller skate with its wheel axes in a straight horizontal line, FIG. 2 is a side elevation of an entire roller skate with its wheel axes on a curve, concave upwards, FIG. 3 is a rear elevation of the skate of FIG. 2 in use negotiating a curve with the wheel positions indicated by crosses in the lower part of the Figure, and FIG. 4 contains a side and exploded end elevations of an embodiment of the invention, FIG. 5 shows different fixing possibilities between the chassis and carrier of FIG. 4, FIG. 6 shows side and end elevations of the skate of FIG. 4 together with different bracing bars which may be secured thereto, FIGS. 7 and 8 show different embodiments of wheels on their chassis and FIG. 9 shows an integral boot and carrier.

FIGS. 1 to 3 have already been described. In FIG. 4 an in-line roller skate has its wheels 11 mounted between two separate chassis rails 1 and 2. The chassis rails are the resilient components, and made of metal, timber, carbon-fibre or similar synthetic material, either solid or laminated. The chassis rails are fastened together by machined screws 3 and nuts 4 which screws also function as the axles, and locate the wheel assemblies between the chassis rails. (The wheel assembly consists of—wheel, a ball race and centre bush in the standard established manner and is not illustrated in detail.)

Additional bushes 5 are inserted in the chassis rails, one each side of the wheel assembly 6 to locate the axle screws 3 in apertures in the chassis rails 1 and 2 and the assemblies centrally between the chassis rails. The additional bushes are optional components.

Assembled together these components 1 to 6 form the carriage 12. Depending on the forces applied to it, the carriage will deflect in the plane of rotation of the wheels so that the wheel axes will move vertically relative to each other.

The carriage is fastened to the fixed carrier 7 which is rigid and itself provided with means for securing to the sole of the boot 13. The screws 8 secure the carriage to the carrier, with nuts or threaded inserts (not shown). The carrier and carriage are provided with several location holes spaced along their length, providing a means whereby the carrier provides various degrees of stiffening to the carriage depending on location and the distance between the screws 8 and the number of screws actually used. In order to provide the desired flexing to change between optimum speed and turning performance, I have found that it is necessary to limit the distance between the front fixing screw and the rear fixing screw (defined as the fixing length) to a maximum of two thirds of the distance between the axis of the front wheel and the axis of the rear wheel (defined as the effective length of the chassis).

FIGS. 5*a–c* display screws 8 in different locations being used to vary the degree of stiffness transferred from the carrier to the carriage. The full length of the chassis is not shown in these figures.

FIGS. 6*a–c* display an alternative means of adjusting the degree of stiffness in the carriage assembly. Bracing bars 9 which may be of various lengths and made of comparatively rigid material are fastened longitudinally to the chassis rails 1 and 2. In FIGS. 5 and 6 the vertical dimension of the chassis is uniform throughout the length.

FIGS. 7*a–c* display chassis rails of a variety of finished shapes, each providing different flexing characteristics. Each has a central section of greater vertical dimension than the end section.

FIG. 8 displays chassis rails constructed as a concave arch. With this shape, the centre wheels or wheel do not make contact with the ground until the carriage has flexed due to the downforce provided by the mass of the skater.

FIG. 9 displays the alternative of a boot and the rigid carrier moulded as one component. All or part of the boot can be moulded in one piece with the carrier. The chassis and wheels (not shown in this figure) are secured to the carrier as described above.

I claim:

1. A roller skate attachment for securing to a boot comprising:

a single row of aligned wheels for travelling on the ground, including a front wheel and a rear wheel;

a rigid carrier which is adapted to be secured to a boot;

a chassis for supporting the row of wheels, said chassis being formed of a resilient material in order to be resiliently deformable in a plane of rotation of the wheels; and a securing means for securing the carrier to the chassis at front and rear fixing points located between an axis of a front wheel and an axis of a rear wheel such that a distance between the axis of the front wheel and the axis of the rear wheel is at least 1.5 times a distance between the front fixing point and the rear fixing point, and such that at least one of a front portion of the chassis ahead of the front fixing point and a rear portion of the chassis behind the rear fixing point is flexible due to the resilient material of the chassis from a level position to a rocking position in response to forces between a user's foot and the ground.

2. An attachment as claimed in claim 1 wherein the chassis comprises two members secured together side by side transversely in relation to said plane, one member on either side of the row of wheels.

3. An attachment as claimed in claim 1 wherein said securing means includes a plurality of matching holes through the carrier and the chassis and securing devices which are passed through selected matching holes to form said fixing points.

4. An attachment as claimed in claim 1 and further comprising rigid members secured longitudinally along the central portion of the chassis.

5. An attachment as claimed in claim 1 wherein the row of wheels includes at least one intermediate wheel between the front and rear wheels, and wherein, in the level position, the chassis supports the front and rear wheels on a plane surface and the at least one intermediate wheel raised therefrom.

* * * * *